United States Patent [19]

Fram

[11] Patent Number: 4,509,903

[45] Date of Patent: Apr. 9, 1985

[54] CATALYST SLAVE PUMP

[76] Inventor: Jerry R. Fram, 10627 Rochester Ave., Los Angeles, Calif. 90024

[21] Appl. No.: 543,089

[22] Filed: Oct. 18, 1983

[51] Int. Cl.[3] ..... F04B 19/02; F04B 23/04; F15B 15/24; B67D 5/52

[52] U.S. Cl. ..... 417/464; 417/429; 417/554; 92/13.3; 92/13.5; 92/171; 222/135; 74/105; 74/110

[58] Field of Search ..... 417/554, 545, 426, 429, 417/460, 469, 464; 92/13.3, 13.5, 13.51, 13.7, 171; 222/135, 309; 74/105, 110

[56] References Cited

U.S. PATENT DOCUMENTS

| | | | |
|---|---|---|---|
| 1,263,201 | 4/1918 | Brown | 417/554 X |
| 2,103,967 | 12/1937 | Boyett | 417/464 |
| 2,253,122 | 8/1941 | Hamant | 417/547 X |
| 2,433,812 | 12/1947 | Hastings, Jr. et al. | 417/460 |
| 2,807,213 | 9/1957 | Rosen | 417/429 X |
| 2,925,780 | 2/1960 | Tear | 417/399 |
| 2,954,737 | 10/1960 | Hoover | 92/13.3 X |
| 3,169,674 | 2/1965 | Lund et al. | 417/469 X |
| 3,279,376 | 10/1966 | Hart | 417/429 |
| 3,499,387 | 3/1970 | Zippel | 92/13.5 X |
| 3,583,837 | 6/1971 | Rolsten | 417/554 |
| 3,612,732 | 10/1971 | Stephans | 417/426 X |
| 3,642,175 | 2/1972 | Robbins | 222/135 |
| 3,694,108 | 9/1972 | Pensa | 417/222 |
| 3,786,729 | 1/1974 | Rizzone | 92/171 |
| 3,790,030 | 2/1974 | Ives | 222/135 |
| 3,814,289 | 6/1974 | Robbins | 222/135 |
| 3,871,268 | 3/1975 | Misima | 417/429 X |
| 4,080,874 | 3/1978 | Burkhard | 417/429 X |
| 4,164,799 | 8/1979 | Jai | 92/171 X |
| 4,182,387 | 1/1980 | Buckley et al. | 74/600 X |
| 4,189,070 | 2/1980 | Macosko et al. | 417/429 X |
| 4,210,261 | 7/1980 | Trujillo et al. | 222/309 X |
| 4,312,463 | 1/1982 | Daby | 417/429 X |
| 4,349,321 | 9/1982 | Bentley | 417/429 X |

FOREIGN PATENT DOCUMENTS

| | | | |
|---|---|---|---|
| 2396184 | 3/1979 | France | 417/429 |

*Primary Examiner*—Carlton R. Croyle
*Assistant Examiner*—Paul F. Neils
*Attorney, Agent, or Firm*—Joseph E. Mueth

[57] ABSTRACT

The novel slave pump having a piston rod having a fluid passage through which catalyst is discharged for ultimate use. The slave pump also has an exterior casing which holds it together without contacting the catalyst or other fluids being pumped.

A novel combination of a slave pump as just described driven by a master pump having a cylinder and a piston rod, a slave pump having a cylinder and a piston rod, a first means interconnecting the piston rod of the master pump with the piston rod of the slave pump, and a second means connecting the cylinder of the master pump with the cylinder of the slave pump.

The position of the slave pump can be adjusted with respect to the master pump to change the amount of catalyst or other fluid delivered by said slave pump per stroke of the slave pump piston. The interconnecting linkages are provided with spherical connections to mitigate wear and binding due to misalignment.

7 Claims, 5 Drawing Figures

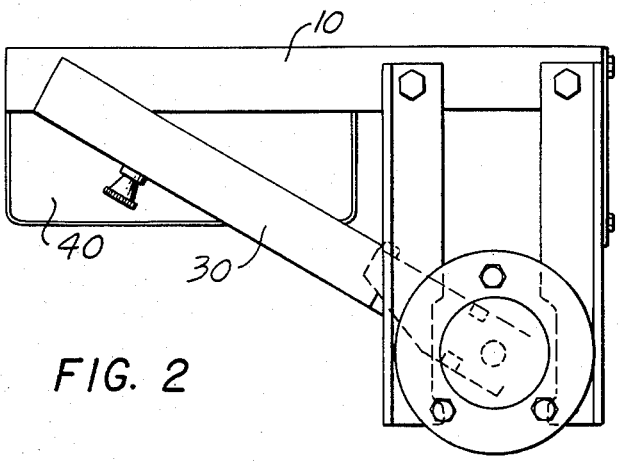
FIG. 2
FIG. 1
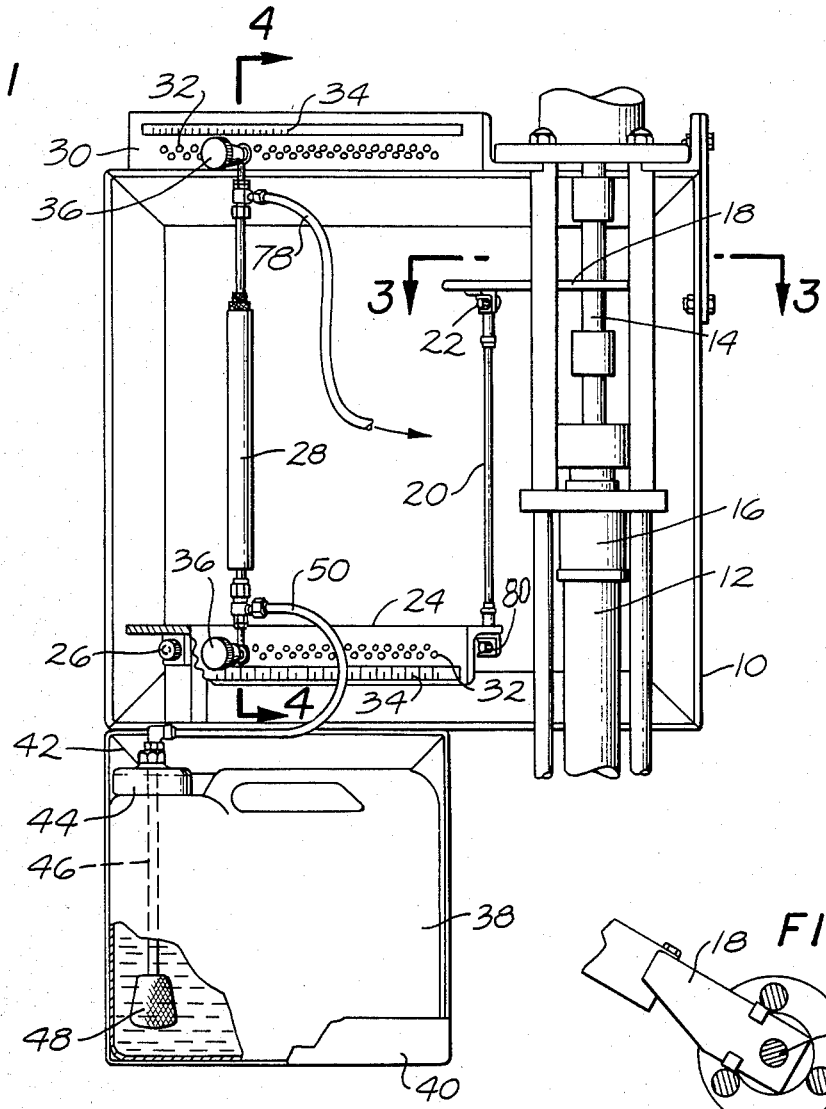
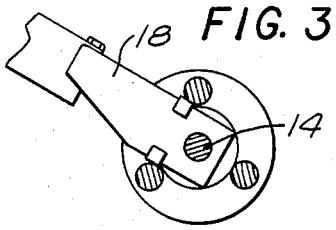
FIG. 3

CATALYST SLAVE PUMP

BACKGROUND OF THE INVENTION

Spray-up and gel coating, resin transfer molding (RTM) and other less important procedures like pouring or casting of polyester require the controlled combination of resin with catalyst.

Heretofore, various means have been used for metering catalyst including:

Venturi tube and needle valve into air stream from a pressure pot. The air stream with atomized catalyst is then used to spray the polyester resin. The catalyst metered is proportional to airflow.

It has also been proposed to meter with only a pressure pot and needle valve. This method uses less air and therefore possibly poisons the environment less than the first method.

Another approach involves metering with a catalyst pump which is not slaved to the resin pump but pumps at a constant rate.

In addition, there is at least one slave pump on the market, made by Venus Products, Inc. It is designed for metering catalyst into a spray gun which internally mixes resin and catalyst. The device is also the subject of U.S. Pat. No. 3,790,030. The present invention presents a significant advance thereover as will more fully hereinafter appear.

In the patent literature to Hoover (U.S. Pat. No. 2,954,737), Daby (U.S. Pat. No. 4,312,463) and Stephans (U.S. Pat. No. 3,612,732) disclose various pumping devices wherein a slave pump is mechanically interconnected to, or driven by, a master pump. In Hoover and Stephans the connection is by way of a fixed arm to which the slave pump cylinder is connected and a movable arm connected to the slave pump piston rod. In Hoover, the movable arm is driven by the master pump rod, while in Stephans the movable arm is driven via a cam mechanism. In the device of Daby, the master pump piston rod is mechanically connected to the slave pump piston rod via a movable arm. The hydraulic output of the slave cylinder drives a slave pump. The slave pump of Hoover utilizes a separate outer tube for the cylinder and contains all of the inlet, outlet, and valve structure in separate attachments at each end of the separate tube. In all three of these patents, the position of the slave cylinder is disclosed as being adjustable along the length of the movable arm in order to adjust the output of the slave pump. In each of these patents, pivoting connections are utilized between a slave pump and the fixed and movable arms.

The patent to Bentley (U.S. Pat. No. 4,349,321) shows a slave pump utilizing a separate outer tube without an inlet or an outlet. The respective inlets and outlets as well as the valving structure are connected in end units which are attached to the separate tube.

The patents to Buckley et al (U.S. Pat. No. 4,182,387), Robbins (U.S. Pat. No. 3,814,289), and Pensa (U.S. Pat. No. 3,694,108) show various means of attaching pumps to their actuating arms. In Buckley et al, universal joints are utilized to interconnect the pump cylinder and the piston rod to fixed and movable arms respectively. Robbins discloses a mixing apparatus utilizing a plurality of individual pumps wherein each of the pumps are connected to a common actuating rod. The connection between the pumps' piston rods and the actuating rods are by way of a roller-type structure. Pensa discloses the use of spherical bearings to interconnect the piston rods of a pump to a capacity adjusting mechanism.

The patents to Macosko et al (U.S. Pat. No. 4,189,070) and Robbins (U.S. Pat. No. 3,642,175) show pumping devices with slave pumps to inject a measured amount of material in conjunction with a master pump. In each case, a movable arm interconnects the piston rod of the master pump with the piston rod of the slave pump.

Some of these prior procedures have various drawbacks and disadvantages including air pollution and lack of adequate control of the proportioning of resin-to-catalyst. Others are excessively complex.

SUMMARY OF THE INVENTION

Briefly, the instant invention comprehends a reciprocating slave pump having:

a cylinder, a piston within said cylinder, a hollow rod connected to said piston, said piston and hollow rod being reciprocable within said cylinder, an opening in the face of said piston and a check valve for regulating flow through said piston and into said hollow rod, a first fixed plug forming one end of said cylinder, a check valve in the face of said plug for regulating flow through said plug, and an inlet passage communicating with the valve in the plug for introducing liquid into said cylinder, a second fixed plug at the opposite end of said cylinder, said hollow rod passing slidably therethrough, the interior of said hollow rod communicating with both the discharge passage for said pump and with the annular space within said cylinder between said piston and said second plug which surrounds the exterior of said rod, said check valves being disposed so that on the up stroke of the piston, the valve in the first plug is open while the valve in the piston is closed, and on the down stroke, the valve in the piston is open whereby fluid is discharged from said discharge passage on both the up stroke and the down stroke of said piston and hollow rod, the fluid discharged on the up stroke being displaced through said hollow rod due to the flow of fluid from said annular space and the fluid discharged on the down stroke being due to displacement of fluid through said hollow rod from the space between said first fixed plug and said piston, said down stroke also replenishing said annular space with fluid.

The present invention also comprises a combination comprising:

a master reciprocating pump for pumping a first fluid such as liquid resin, a reciprocating slave pump for pumping a second fluid such as liquid catalyst, means for restraining one end of said slave pump in a fixed position with respect to the master pump, means for moving the other end of said slave pump relative to the end which is restrained, said means for moving being interconnected to and driven by the reciprocating portion of said master pump, both said means for restraining and means for moving having adjustment means whereby the extent of movement of said other end of said slave pump can be changed to thereby changing the ratio of resin to catalyst dispensed;

the improvement wherein said means for moving include one or more articulated joints provided with spherical bearings.

In an important aspect, it is an object of the invention to provide a slave pump having a hollow connecting rod for conducting fluid to a discharge opening.

In another aspect of the invention, the slave pump has an exterior casing which holds it together without contacting the catalyst or other fluids being pumped.

It is an object of this invention to provide a novel slave pump—master pump combination.

More particularly, it is an object of this invention to provide a combination wherein the linkage between slave pump and master pump are provided with spherical bearings.

These and other objects and advantages of this invention will be apparent from the detailed description which follows.

DESCRIPTION OF THE PREFERRED EMBODIMENTS

This invention relates to a slave pump that is mechanically connected to a master pump such that the slave pump delivers a specified amount of catalyst (or other fluid) with the amount of resin material (or other and different fluid) pumped by the master pump. The slave pump is interconnected at each end to an adjustable arm. By adjusting the position of the slave pump along either of the arms, the amount of catalyst delivered per stroke may be adjusted. The piston rod and the cylinder of the slave pump are attached to the arms by way of spherical bearings to minimize the amount of precision machining and to inhibit binding of the mechanism during its operation. The piston rod of the slave pump is formed of hollow tubing so that the catalyst may be discharged through the piston rod. This eliminates the need to machine a port in the body or cylinder of the slave pump and requires less stainless steel to manufacture the pump. The slave pump also uses a separate outer tube with structure to retain the bottom check valve and the top packing in place such that none of these parts contact the catalyst material. This enables them to be fabricated from less expensive materials than stainless steel.

Turning to the drawings:

FIG. 1 is a side view of the master pump-slave pump combination of this invention.

FIG. 2 is a top view of the apparatus shown in FIG. 1.

FIG. 3 is a sectional view taken along the line 3—3 in FIG. 1.

Figure 4:
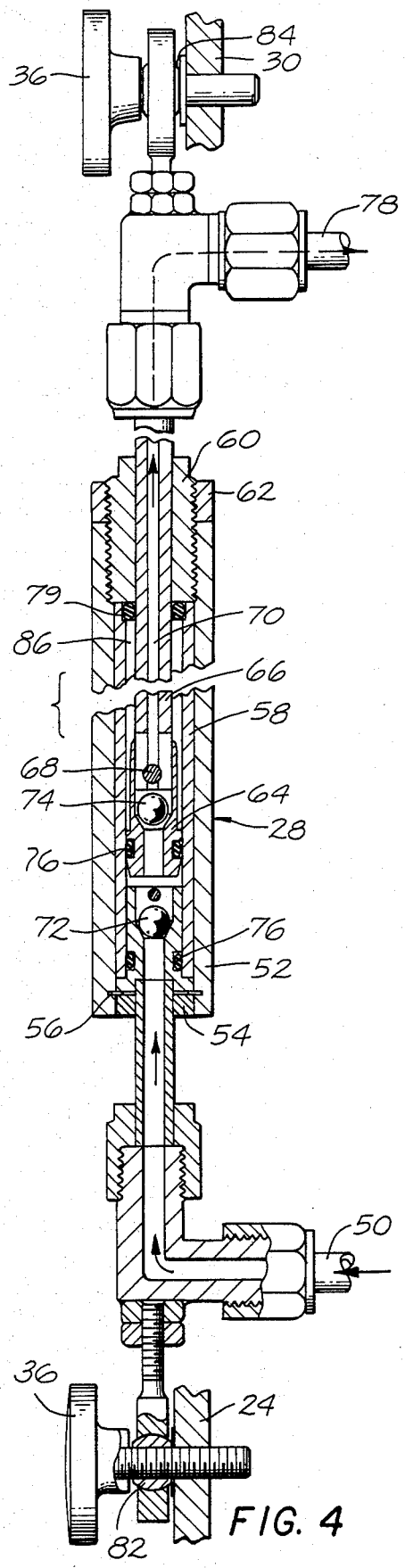
FIG. 4 is a sectional view of the slave pump taken along the line 4—4 in FIG. 1.

Considering the drawings in more detail, in FIG. 1, frame 10, supports the master pump 12 which dispenses the resin. The master pump 12 has a piston rod 14 which reciprocates within cylinder 16. Affixed to piston rod 14 is drive link 18. Connecting link 20 is held to drive link 18 by Allen screw connection 22 which includes a spherical bearing. The lower end of connecting link 20 is attached to pivoting metering arm 24. Shoulder bolt 26 connects arm 24 to frame 10 and allows that end of arm 24 to pivot therearound. Catalyst slave pump 28 is held between arm 24 and upper arm 30. Both arms 24 and 30 are provided with a plurality of holes 32 as well as metering legends 34. Fasteners 36 which include spherical bearings 82 and 84 connect the catalyst slave pump 28 to arms 24 and 30.

Catalyst reservoir 38 is held in mount 40 and is provided with an upper bulkhead 42 and retainer 44 which holds wand 46 in place. The lower end of wand 46 is provided with strainer 48.

The wand 46 communicates with inlet tube 50 which feeds catalyst to catalyst slave pump 28 from reservoir 38.

Figure 5:
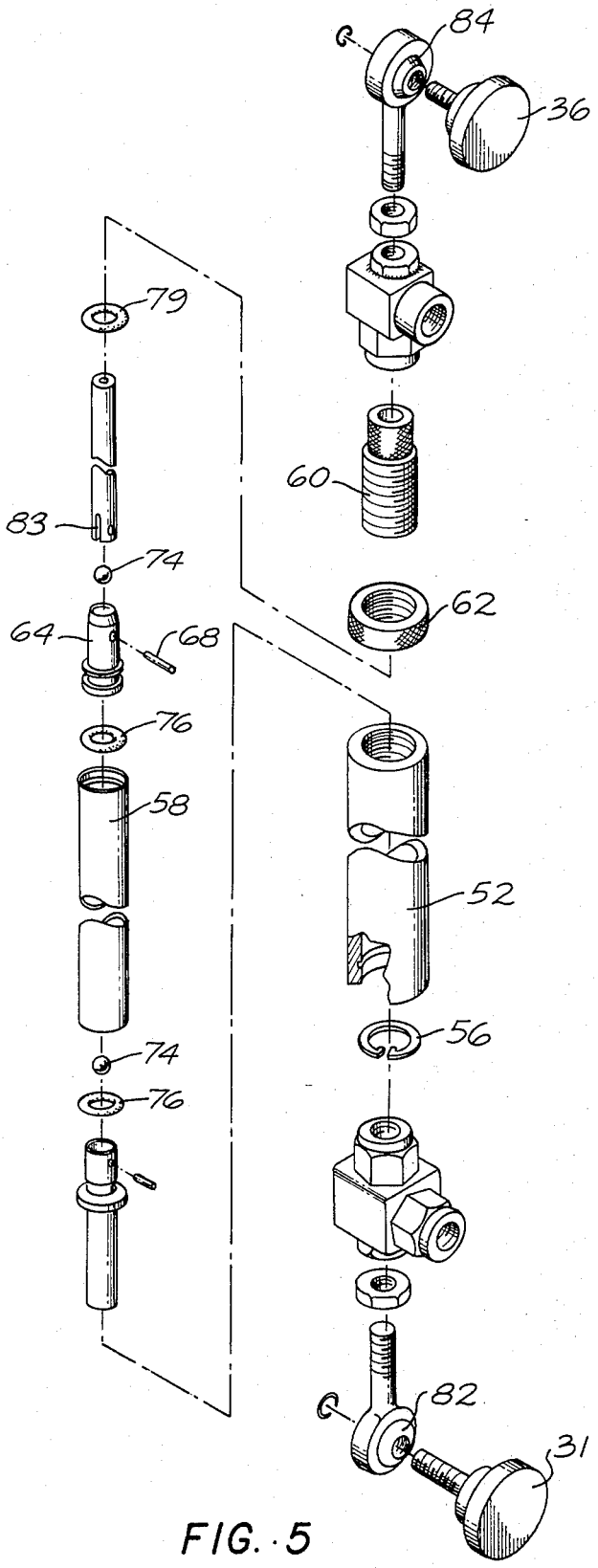
FIG. 5 is an exploded view of the slave pump and is generally co-extensive with FIG. 4.

The catalyst slave pump 28 is shown in more detail in FIGS. 4 and 5. The inner members of the slave pump are all those items shown on the left vertical center line of FIG. 5 from bottom plug 54 through the hollow piston rod 66 and top seal 79. These members are held together inside the outer casing 52 clamped between retaining ring 56 on one end of said outer casing 52 and upper plug 60, which is screwed into the opposite end of said outer casing 52. Item 62, a jam nut, is used to prevent upper plug 60 from unscrewing. The piston 64 and connecting rod 66 connected thereto by wrist pin 68 are adapted to reciprocate with respect to casing 52 and cylinder liner 58.

The connecting rod 66 has a hollow internal fluid passage 70 over its length.

The upper portion of bottom plug 54 is provided with a seat for ball 72. Similarly, the upper portion of piston 64 has another seat, this one for ball 74.

A series of "O" packing rings 76 and 79 seal the system.

The upper end of the catalyst slave pump 28 leads to discharge tube 78.

The details of the master pump 12 are not shown since this unit is available from ARO.

In operation, the stroke of the piston 64 within the catalyst slave pump 28 can be changed simply by moving the pump left to right along arms 24 and 30. This is done by unfastening fasteners 36 and reinserting them at a different pair of holes along arms 24 and 30. The positions along arms 24 and 30 can be indexed in the form of metering legends 34.

The general operation involves the connecting link 20 which moves up and down, parallel to the movement of piston rod 14. The articulated joint 80 has a spherical bearing and allows the lower arm 24 to pivot or swing in an arc about shoulder bolt 26. The closer along arm 24 the slave pump 28 is connected to shoulder bolt 26, the shorter is the stroke of reciprocating piston 64 and rod 66 and the less catalyst is dispensed per stroke. By fastening the pump 28 to arm 24 at a point more remote from shoulder bolt 26, the stroke of pump 28 is increased. It will be understood that the adjustment just explained is to be accompanied by a corresponding lateral movement of the point of attachment of pump 28 to fixed upper arm 30.

The operation of the catalyst slave pump 28 is such that on the first intake or up stroke of piston 64, fluid catalyst is drawn via inlet 50 and past check valve 72 while ball 74 remains seated or closed. This fills the space within the cylinder between first plug 54 and piston 64 with catalyst. On the first exhaust or down stroke, ball 72 closes and ball 74 opens to allow the catalyst to be forced through passage 70 in connecting rod 66. Connecting rod 66 has a side opening 82 therein which permits part of the catalyst to flow into annular space 86 and the other part to flow upwardly in hollow rod 66 to fill up passage 70. The pump 28 is now primed.

On each subsequent up stroke, piston 64 draws in new catalyst as it moves upward and at the same time displaces the catalyst from the annular space 86 via opening 83 back into passage 70, causing catalyst to be discharged through passage 70 at discharge tube 28. On the down stroke, one-half of the volume of catalyst below piston 64 passing past valve 74 is discharged at tube 78, while the other half refills the annular space 86. Because the area of annular space 86 is one-half the area of the cylinder between first plug 54 and piston 64 the same amount of catalyst is discharged on both the up stroke and the down stroke. The passage 70 eliminates the need for valves, ports and the like which are expensive and complex.

The advance of the present invention includes:

1. Use of tubing for the piston rod 66 of the pump 28 with a passage permitting catalyst to be discharged through this tube. This method eliminated the need for machining a port in the body of the slave pump or in a separate top plug. Also, less stainless steel is required to manufacture the pump. Stainless steel is used in all parts contacting the catalyst because the catalyst is chemically very reactive, and other commonly available metals will corrode.

2. Use of a separate outer tube 52 with retaining ring 54, top plug 60, and nut 62 to hold the bottom check valve 72 and the top packing ring 76 in place and to contain the piston assembly. None of these above parts contact the catalyst. As a consequence, they can be made out of less expensive, more freely machining materials than the stainless steel.

3. The use of spherical bearings 82 and 84 fastened tightly with screws 36 in this invention to mount the slave pump between a point on the fixed arm 30 and a point on the pivoting arm 24. This method eases the precision in machining required to obtain a pumping action without play which does not bind or overly stress the pump. Mounting of spherical bearings 22 and 80 also provides greater flexibility and avoids wear due to misalignment.

The pump of this invention can be assembled and disassembled to access all the seals completely by hand. To build in these features with a single piece of stainless steel body would require greater expense in machining and materials.

The preferred use of the device of this invention is to meter catalyst in adjustable proportions to polyester resin pumped with a drum pump.

The pumping rate of resin is typically about one gallon per minute and the proportion of catalyst is typically ½%–3%. Adjustment in the field of the proportion of catalyst to resin is normally required because the optimum ratio depends on temperature and other factors.

Having fully described the invention it is intended that it be limited solely by the lawful scope of the appended claims.

I claim:

1. The combination comprising:

a supporting frame, a master reciprocating pump for pumping a first liquid and fixed to said frame, said master pump having a cylinder and a piston and rod reciprocating within said cylinder, a reciprocating slave pump for pumping a second liquid, a first arm affixed to said frame, said first arm holding one end of said slave pump in a fixed pivoting position with respect to the master pump, affixed to said piston rod, one end of a drive link, a connecting link, the other end of said drive link being joined to the upper end of said connecting link by a spherical bearing connection, a second arm disposed in the same plane as said first arm, the lower end of said connecting link being joined to said second arm by a spherical bearing joint, said second arm being pivotally connected at a point spaced apart from said spherical bearing joint, to said frame, spherical bearing connections connecting said slave pump to said first arm and said second arm, whereby as said piston rod reciprocates, said connecting link moves generally parallel to said piston rod and said second arm is moved by said connecting link in an arc about the end pivotally connecting to the frame and said slave pump is caused to reciprocate by the relative movement of said second arm with respect to said first arm.

2. The combination of claim 1 wherein said first arm and said second arm each has a series of laterally disposed openings therein whereby the extent of reciprocation of the slave pump can be changed to alter the ratio of said second liquid to said first liquid dispensed.

3. The combination of claim 1 wherein said reciprocating slave pump has:

a cylinder, a piston within said cylinder, a hollow rod connected to said piston, said piston and hollow rod being reciprocable within said cylinder, an opening in the face of said piston and a check valve for regulating fluid flow through said piston and into said hollow rod, a first fixed plug forming one end of said cylinder, a check valve in the face of said plug for regulating flow through said plug, and a fluid inlet passage communicating with the valve in the plug for introducing liquid into said cylinder, a second fixed plug at the opposite end of said cylinder, said hollow rod passing slidably therethrough, a fluid discharge passage for said pump being in fluid communication with the interior of said hollow rod, an annular fluid space within said cylinder between said piston and said second plug, said annular space surrounding the exterior of said rod, the interior of said hollow rod communicating with both said discharge passage for said pump and said annular space, the interior of said hollow rod communicating with both said discharge passage for said pump and said annular space, said check valves being disposed so that on the up stroke of the piston, the valve in the first plug is open while the valve in the piston is closed, and on the down stroke, the valve in said first plug is closed and the valve in the piston is open whereby fluid is discharged from said discharge passage on both the up stroke and the down stroke of said piston and hollow rod, the fluid discharged on the up stroke being displaced through said hollow rod due to the flow of fluid from said annular space and the fluid discharged on the down stroke being due to displacement of fluid through said hollow rod from the space between said first plug and said piston, said down stroke also replenishing said annular space with fluid.

4. The combination of claim 3 having an outer tube around the exterior of said cylinder, said outer tube being out of contact with said fluid passages and spaces, said first fixed plug and said second fixed plug being snuggly received in the opposite ends of said outer tube to seal said outer tube, complementary interacting retaining means on said outer tube, said first fixed plug and said second fixed plug for holding the pump together.

5. A reciprocating pump having:

a cylinder, a piston within said cylinder, a hollow rod connected to said piston, said piston and hollow rod being reciprocable within said cylinder, an opening in the face of said piston and a check valve for regulating fluid flow through said piston and into said hollow rod, a first fixed plug forming one end of said cylinder, a check valve in the face of said plug for regulating flow through said plug, and a fluid inlet passage communicating with the valve in the plug for introducing liquid into said cylinder, a second fixed plug at the opposite end of said cylinder, said hollow rod passing slidably therethrough, a fluid discharge passage for said pump being in fluid communication with the interior of said hollow rod, an annular fluid space within said cylinder between said piston and said second plug, said annular space surrounding the exterior of said rod, the interior of said hollow rod communicating with both said discharge passage for said pump and said annular space, an outer tube around the exterior of said cylinder, said outer tube being out of contact with said fluid passages and spaces, said first fixed plug and said second fixed plug being snuggly received in the opposite ends of said outer tube to seal said outer tube.

complementary interacting retaining means on said outer tube, said first fixed plug, and said second fixed plug for holding the pump together, said check valves being disposed so that on the up stroke of the piston, the valve in the first plug is open while the valve in the piston is closed, and on the down stroke, the valve in said first plug is closed, and the valve in the piston is open whereby fluid is discharged from said discharge passage on both the up stroke and the down stroke of said piston and hollow rod, the fluid discharged on the up stroke being displaced through said hollow rod due to the flow of fluid from said annular space and the fluid discharged on the down stroke being due to displacement of fluid through said hollow rod from the space between said first plug and said piston, said down stroke also replenishing said annular space with fluid.

6. The device of claim 5 wherein said second fixed plug has external threads and said outer tube has complementary internal threads to form said interacting retaining means.

7. The device of claim 6 additionally provided with a jam nut which engages said second fixed plug to prevent it from unscrewing.

* * * * *